US005622353A

United States Patent [19]

Painter et al.

[11] Patent Number: 5,622,353

[45] Date of Patent: Apr. 22, 1997

[54] HIGH POWERED RESCUE TOOL

[75] Inventors: Alan J. Painter, Bolingbrook, Ill.; Patrick J. Slepekis, Sturgeon Bay, Wis.

[73] Assignee: Amkus, Inc., Lisle, Ill.

[21] Appl. No.: 451,660

[22] Filed: May 30, 1995

[51] Int. Cl.[6] ..... B66F 3/24

[52] U.S. Cl. ..... 254/93 R; 72/705

[58] Field of Search ..... 254/18, 93 R, 254/93 H, 93 HP, 124, 104; 72/392, 705; 29/252, 239; 81/302, 349, 383.5

[56] References Cited

U.S. PATENT DOCUMENTS

| | | | |
|---|---|---|---|
| 2,447,401 | 8/1948 | Ferguson et al. . | |
| 2,606,469 | 8/1952 | Morgenthaler . | |
| 3,292,903 | 12/1966 | Meyer et al. . | |
| 3,819,153 | 6/1974 | Hurst et al. . | |
| 4,273,311 | 6/1981 | Rio | 254/93 R |
| 4,392,263 | 7/1983 | Amoroso . | |
| 4,475,373 | 10/1984 | Ikenberry . | |
| 4,531,289 | 7/1985 | Brick . | |
| 4,842,249 | 6/1989 | Weigand | 254/93 R |
| 4,896,862 | 1/1990 | Ganley . | |
| 4,973,028 | 11/1990 | Linster . | |

FOREIGN PATENT DOCUMENTS

| | | | |
|---|---|---|---|
| 2621249 | 11/1977 | Germany | 72/392 |

OTHER PUBLICATIONS

Amkus brochure entitled AMKUS MEGA® SERIES, published in Fall of 1994.

*Primary Examiner*—Robert C. Watson

[57] ABSTRACT

A rescue tool comprising a housing, a pair of spreader arms each including a working portion and a driven portion and a pivot point therebetween, wherein the driven portion of each spreader arm contains an arced portion which touches the arced portion of the other spreader arm, a pair of links having first and second ends, a drive means reciprocally moveable between retracted and extended positions along an axis of movement, a first pivotal coupling means for coupling the driven portion of the spreader arm to the first end of the associated links, a second pivotal coupling means for coupling the second end of the associated links to the drive means, a third pivotal coupling means for coupling the spreader arm pivot point to the housing, the second coupling means being located between the first pivotal coupling means and the working portion when measured along the axis of movement.

12 Claims, 1 Drawing Sheet

HIGH POWERED RESCUE TOOL

BACKGROUND OF THE INVENTION

This patent application relates generally to a new and improved, light-weight, fluid-driven, high-powered rescue tool and, specifically, to a new and improved system for driving the rescue tool.

High powered rescue tools are shown in U.S. Pat. Nos. 3,819,153, 4,896,862, 4,531,289, and 4,973,028. They are typically used to extricate victims from metal enclosures, such as automobiles, buses, trucks, elevators, airplanes, trains, and other devices involved in accidents. In addition, rescue tools are used to extricate victims from collapsed concrete and steel structures due to natural disasters, such as earthquakes.

To accomplish successful rescues, several types of rescue tools have been developed, including tools known as spreaders, cutters, and rams. The present invention relates to spreader rescue tools. Spreader tools generally include a pair of spreader arms, a fluid cylinder, and a support structure or housing. The spreader arms are pivotally attached to the housing in a manner that allows them to rotate about pivot points in response to the extension of a fluid cylinder piston rod.

Spreader tools are ordinarily used in two ways. First, they are used to separate or spread the entrapping device that has trapped the victim. To do this, the spreader arms are inserted, in a closed position in which the ends or working portions of the spreader arms are in contact with each other, into a gap or opening that is either present in the device or created by another rescue tool. The spreader arms are then rotated about their respective pivot points to separate, or spread, the working portions from each other, thereby creating an opening in the entrapping device through which the victim can be removed or, at least, removal can be facilitated. The working portions of the spreader arms ordinarily separate to distances of approximately thirty inches to create openings sufficient to effectuate removal of victims.

The second way spreader tools are used is to compress the entrapping device. This is accomplished by reversing the procedure described above. That is, the entrapping device is placed between the open spreader arms which are then rotated about their respective pivot points to close, or bring together the working portions, thereby compressing or crushing the entrapping device.

Various forms of drive mechanisms have previously been employed to rotate the spreader arms about their respective pivot points to separate the working portions to the desired distances. For example, U.S. Pat. No. 3,819,153 discloses a drive system whereby the spreader arms are pivotally connected through drive linkages to a piston rod which, when extended, pushes the spreader arms to rotate about a fixed pivot point. Alternatively, the piston rod has been pivotally attached directly to the spreader arms, allowing the spreader arms to rotate about a moveable pivot point which is connected to a housing through pivoting linkages, as shown in U.S. Pat. No. 4,392,263. Further, rack and pinion drive systems have been utilized to rotate the spreader arms. In some instances the pinion gear has been incorporated into the spreader arm while the rack has been attached to a piston rod of a hydraulic cylinder, thereby causing the working portions to spread in response to extension of the piston rod.

In each of the drive systems discussed above, the spreading force generated at the working portions is greatest when the working portions approach their maximum separation distance, or about 30 inches. However, the range of separation distance most commonly used for this type of rescue tool is the first ten inches of spreader arm separation. Moreover, in practical application, the greatest working tip spreading forces are required at the start of the spreading function when the resistance of the entrapping device to spreading is at its highest level.

SUMMARY OF THE INVENTION

It is, therefore, an important object of this invention to provide a system to drive a rescue tool that provides maximum spreading force at the working portions when the working portions are relatively close together.

Another object of the invention is to provide a drive system that maintains relatively high spreading force at the working portions at all distances of working tip separation.

In summary, in the present invention there is provided a rescue tool comprising a housing, a pair of spreader arms each including a working portion and a driven portion and a pivot point therebetween, wherein the driven portion of each spreader arm touches the driven portion of the other spreader arm, a pair of links having first and second ends, a drive means reciprocally moveable between retracted and extended positions along an axis of movement, a first pivotal coupling means for coupling the driven portion of the spreader arm to the first end of the associated links, a second pivotal coupling means for coupling the second end of the associated links to the drive means, a third pivotal coupling means for coupling the spreader arm pivot point to the housing, the second coupling means being located between the first pivotal coupling means and the working portion when measured along the axis of movement.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the present invention.

BRIEF DESCRIPTION OF DRAWINGS

For the purpose of facilitating an understanding of the invention, there is illustrated in the accompanying drawing a preferred embodiment thereof, from an inspection of which, when considered in connection with the, following description, the invention, its construction and operation, and many of its advantages should be readily understood and appreciated.

DETAILED DESCRIPTION OF THE PREFERRED EMBODIMENTS

Figure 1:
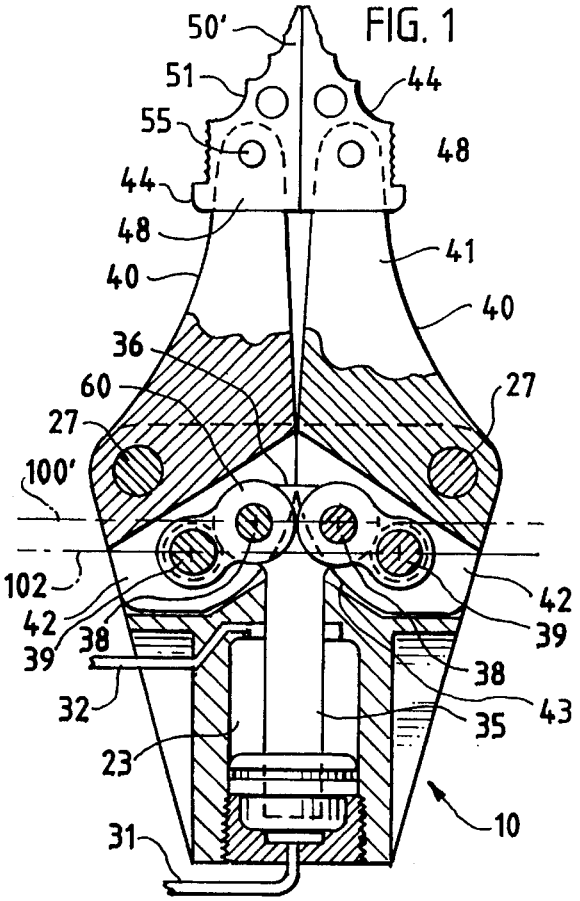
FIG. 1 is a plan view of a rescue tool incorporating the features of the present invention and showing the spreader arms in their closed position, with the forward support plate removed and the lower arm sectioned away to view the drive linkages.
Figure 2:
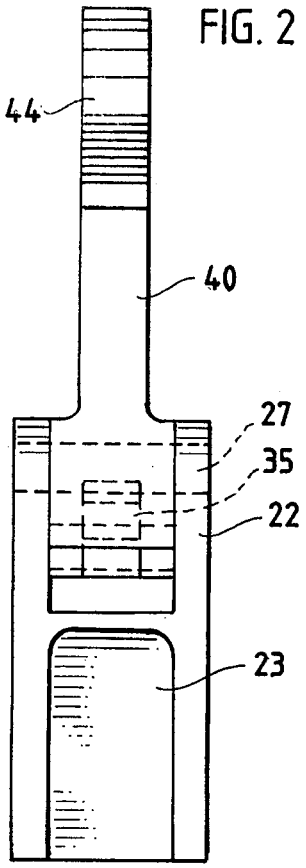
FIG. 2 is a side view of the rescue tool in its closed position.
Figure 3:
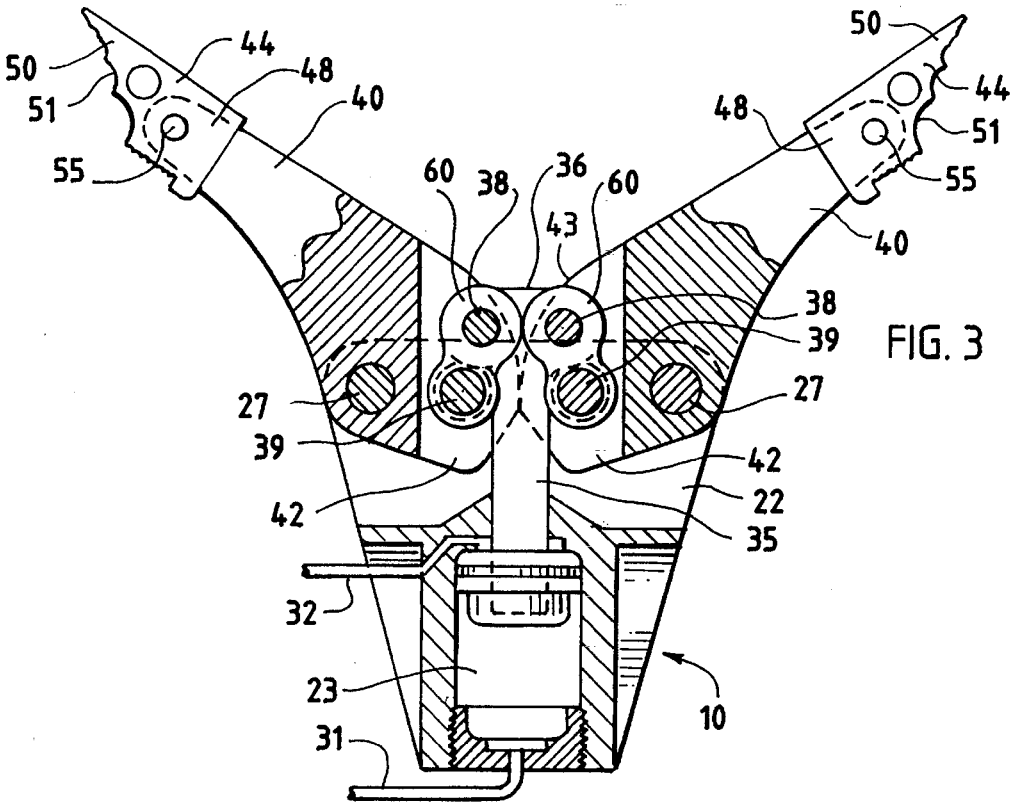
FIG. 3 is a plan view of the rescue tool, in its open position with the forward support plate removed and the lower arm sectioned away to view the drive linkages.

Referring to FIGS. 1, 2 and 3, there is shown a light-weight, high-powered fluid-driven rescue tool 10 capable of generating spreading forces of high magnitude. Rescue tool 10 comprises a housing, in the form of a pair of plates 22 and an hydraulic cylinder 23, and a pair of spreader arms 40. Arms 40 are located between plates 22 and are pivotally coupled therein by means of pins 27.

Each spreader arm 40 has a central portion 41, a driven portion 42 and a working portion 48. Working and central portions 48 and 41 respectively are thinner than driven portion 42. This reduces the weight of the tool without sacrificing structural strength.

On its working portion 48, each arm 40 carries a jaw 44 preferably made of hardened steel and tapered at one end to define a tip 50. The jaw 44 may receive an end of the associated arm 40 and be held in place by a pin 55, as shown in FIGS. 1 and 3, or it may be an integral part of the arm 40. Each jaw 44 has a serrated surface 51.

Hydraulic cylinder 23 has inlet/outlet conduits 31 and 32 and a piston rod 35 having a flattened end 36 to which is pivotally coupled a pair of substantially identical drive links 60 by means of pins 38. In the preferred embodiment, shown in FIGS. 1 and 3, two separate pins 38 pivotally couple links 60 to rod 35 respectively. In an alternative embodiment, such pivotal coupling could be made by a single pin for both links 60.

Links 60 are pivotally coupled to arms 40 by means of pins 39. Spreader arms 40 and links 60 are respectively identical and are configured symmetrically about the axis of movement as shown in FIGS. 1 and 3. This symmetrical configuration causes spreader arms 40 to rotate in unison and spread working tips 50 evenly away from each other.

To open a hole in an entrapping structure, working tips 50, in the closed position (FIGS. 1 and 2), are inserted into a small gap in the entrapping structure. The tool is energized by delivering fluid into cylinder 23 through conduit 31, causing rod 35 to be extended from cylinder 23. As rod 35 is extended from cylinder 23, pins 38 move parallel to the axis of rod 35 causing links 60 to follow. In response to the extension of rod 35, driven portions 42 of arms 40 are rotated about associated pins 27 by the pivotal coupling of driven portion 42 to links 60. Links 60 pivot about pins 39 as spreader arm 40 rotates about pin 27 and rod 35 extends along the axis of movement. When arm 40 rotates around pin 27, working tips 50 are spread apart. FIG. 3 shows arms 40 in a position where working tips 50 are spread apart in response to the extension of rod 35.

The reverse operation occurs when a structure is compressed. Arms 40 are initially in their open position, as shown in FIG. 3, and the structure to be compressed is sandwiched between serrated jaws 44. Fluid enters cylinder 23 through conduit 32 causing rod 35 to be retracted into cylinder 23. As rod 35 is retracted into cylinder 23, pins 38 move parallel to the axis of rod 35 causing links 60 to follow flattened portion 36 in the direction of movement as links 60 pivot about pins 38. In response to the retraction of rod 35, driven portions 42 of arms 40 are rotated about associated pins 27 by the pivotal coupling of driven portion 42 to links 60. Links 60 pivot about pins 39 as each spreader arm 40 rotates about associated pins 27 and rod 35 retracts along the axis of movement. The spreader arms 40 pivot toward a position in which the working tips 50 are closed or together, as shown in FIGS. 1 and 2, and compress the structure between jaws 44.

Referring to FIGS. 1 and 3, it is an important feature of the present invention that, along the axis of movement of rod 35, pins 38 are always between jaws 44 (working portions 48) and pins 39. In other words, assuming pins 38 define an imaginary line 100 and pins 39 define an imaginary line 102, it is important that line 100 is between jaws 44 and line 102. Pins 38 remain between jaws 44 and pins 39 for all positions of spreader arms 40. As a result, as rod 35 is extended, it pulls links 60 by means of pins 38, and links 60, in turn, pull arms 40 by means of pins 39 around pins 27 to spread working portions 48 apart from each other.

It is also an important feature of the present invention that the arms 40 each have an arc section 43 in the driven portion 42, and that the arc sections 43 roll against each other as the arms 40 are opened. The high magnitude initial spreading forces achieved with this invention are the result of the arced configuration of the arms and the pivotal coupling of spreader arms 40 to rod 35. Because links 60 are pivotally coupled to rod 35 between working portions 48 and driven portions 42, initial spreading forces at working tips 50 are in excess of 160% of those produced by prior art devices. The arced configuration of the arms 40 reduces the compressive forces which may develop in the driven portion 42 of the arm 40, permitting greater spreading forces to be applied without deforming the spreader.

What has been described therefore is an improved, lightweight, fluid-driven rescue tool. The improved rescue tool provides a rescue tool with higher magnitude initial spreading forces while maintaining high magnitude spreading forces at all points of spreader arm separation.

While the preferred embodiment of the present invention has been described, it is understood that the scope of the invention is defined by the following claims.

What is claimed is:

1. A rescue tool comprising a housing, a pair of spreader arms each having a working portion and a driven portion wherein the driven portion of each spreader arm touches the driven portion of the other spreader arm, the spreader arms each having a pivot point located between the working portion and the driven portion, a pair of links each having first and second ends, each of the first and second ends having a pivot point, a drive means reciprocally moveable between retracted and extended positions along an axis of movement, first pivotal coupling means for coupling the driven portion of each of the spreader arms to the first end of the associated link, second pivotal coupling means for coupling the second end of the links to the drive means, third pivotal coupling means for coupling each of the spreader arms at their pivot points to the housing, the second pivotal coupling means being always located between the first pivotal coupling means and the working portion of each spreader arm when measured along the axis of movement.

2. The rescue tool of claim 1, wherein the driven portion of each spreader arm comprises an arced portion and the arced portion of each spreader arm touches the arced portion of the other spreader arm.

3. The rescue tool of claim 1, wherein the driven portion of each spreader arm continually touches the driven portion of the other spreader arm.

4. The rescue tool of claim 1, wherein the drive means includes a cylinder having a piston and a piston rod, the second pivotal coupling means coupling the second end of the associated link to the piston rod.

5. The rescue tool of claim 4, wherein the cylinder is a hydraulic cylinder.

6. The rescue tool of claim 4, wherein the piston rod includes a flattened end having one or more holes therein.

7. The rescue tool of claim 4, wherein the second pivotal coupling means comprises a pin pivotally coupling the associated link to the piston rod.

8. The rescue tool of claim 1, wherein the first pivotal coupling means is a pin.

9. The rescue tool of claim 1, wherein the associated working portions of each of the spreader arm are together when the drive means is retracted and apart when the drive means is extended.

10. The rescue tool of claim 1, and further comprising a jaw on the working portion of each of the spreader arms.

11. The rescue tool of claim 1, wherein the housing includes first and second parallel plates pivotally coupled to the spreader arms.

12. The rescue tool of claim 11, wherein the third pivotal coupling means is a pin passing through the first plate and through the spreader arm pivot point and through the second plate.

* * * * *